US012474149B2

(12) United States Patent
Muller et al.

(10) Patent No.: US 12,474,149 B2
(45) Date of Patent: Nov. 18, 2025

(54) BLASTING SYSTEM

(71) Applicant: DETNET SOUTH AFRICA (PTY) LTD, Johannesburg (ZA)

(72) Inventors: Elmar Lennox Muller, Johannesburg (ZA); Abraham Johannes Liebenberg, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 372 days.

(21) Appl. No.: 18/247,549

(22) PCT Filed: Sep. 28, 2021

(86) PCT No.: PCT/ZA2021/050055
§ 371 (c)(1),
(2) Date: Mar. 31, 2023

(87) PCT Pub. No.: WO2022/073043
PCT Pub. Date: Apr. 7, 2022

(65) Prior Publication Data

US 2025/0271247 A1 Aug. 28, 2025

(30) Foreign Application Priority Data

Oct. 1, 2020 (ZA) ..... 2020/06084

(51) Int. Cl.
*F42D 1/05* (2006.01)

(52) U.S. Cl.
CPC ..... *F42D 1/05* (2013.01)

(58) Field of Classification Search
CPC ..... F42D 1/045; F42D 1/05
See application file for complete search history.

(56) References Cited

U.S. PATENT DOCUMENTS 10,598,002 B2 * 3/2020 Sites ..... E21B 47/095
2017/0074630 A1 3/2017 Kotsonis et al.
2019/0071963 A1 * 3/2019 Sites ..... E21B 47/095

FOREIGN PATENT DOCUMENTS

WO WO-2013116938 A1 * 8/2013 ..... F42D 3/04
WO WO-2015143501 A1 * 10/2015 ..... F42D 1/05
(Continued)

OTHER PUBLICATIONS

International Search Report and Written Opinion for Related Application No. PCT/ZA2021/050055 dated Dec. 13, 2021 (10 pages).
(Continued)

*Primary Examiner* — Jonathan C Weber
(74) *Attorney, Agent, or Firm* — Michael Best & Friedrich LLP

(57) ABSTRACT

A blasting system which includes a blast site with a perimeter which surrounds the blast site, a plurality of spaced apart boreholes at the blast site, a plurality of detonator assemblies, each detonator assembly being positioned in a respective borehole, each detonator assembly including a respective receiver which is responsive to a magnetic signal transmitted from a control device and received by the receiver, a plurality of magnetic field strength meters (MFSMs) positioned at spaced apart locations on the perimeter, each MFSM including a respective unique identifier, each MFSM in response to a magnetic signal detected by the MFSM, producing a respective data signal which is dependent on the strength of the detected magnetic signal and which includes said unique identifier, and a communication arrangement for transmitting said data signals from said MFSMs to a data collection point.

16 Claims, 1 Drawing Sheet

(56) References Cited

FOREIGN PATENT DOCUMENTS

| | | | | | |
|---|---|---|---|---|---|
| WO | WO-2015143502 | A1 * | 10/2015 | ..... | F42B 3/113 |
| WO | 2020037337 | A1 | 2/2020 | | |
| WO | WO-2020263193 | A1 * | 12/2020 | ..... | H04W 4/38 |

OTHER PUBLICATIONS

International Preliminary Report on Patentability for Related Application No. PCT/ZA2021/050055 dated Dec. 23, 2022 (8 pages).
Annex to the International Preliminary Report on Patentability for Related Application No. PCT/ZA2021/050055 dated Dec. 23, 2022 (10 pages).

* cited by examiner

BLASTING SYSTEM

CROSS REFERENCE TO RELATED APPLICATIONS

This application is a U.S. National Phase application of International Application No. PCT/ZA2021/050055, filed Sep. 28, 2021, which claims priority to South African Patent Application No. 2020/06084, filed Oct. 1, 2020, the entire contents of both of which are herein incorporated by reference.

BACKGROUND OF THE INVENTION

This invention relates to a blasting system which is based on the use of through-the-earth signal transmission.

In a blasting system of the kind referred to detonator assemblies placed in various boreholes in a blasting area receive commands transmitted by means of magnetic signals. The signal transmission process is unidirectional if the detonator assemblies do not have sufficient energy available to transmit signals, in return, to a blast control centre. To address this aspect a pre-blast survey of the blasting area is carried out to ensure that deployed detonator assemblies are correctly positioned and that the blasting system is such that command signals from the blast control centre are received reliably. Magnetic field strength meters (MFSMs) are used at different locations to monitor the magnetic field strength for survey purposes. The MFSMs are also deployed shortly before blasting to monitor the magnetic signals as it has been established that variable conditions at the blast site can affect the strength of those signals.

The MFSMs log information during the initial survey and the resulting data is subsequently interrogated to determine optimal placement of the detonator assemblies and optimal deployment of an antenna for transmitting the magnetic signals.

In one technique the MFSMs are deployed in boreholes in a pattern which covers the entire blasting area. A transmitter at the control centre is then operated in a test mode for a predetermined period while the MFSMs log test messages to determine the degree of magnetic field propagation through the earth. The MFSMs are retrieved and interrogated, for example using a tagger with a NFC (near field communication) interface. The acquired data can be analysed to gain an understanding of the through-the-earth transmission process. Additionally the data is of assistance in identifying a fault or a weakness in the system e.g. if a misfire should occur. In a bidirectional blasting system of the kind disclosed in WO2020/037337 the individual detonators have a capability of generating and transmitting a signal which then passes through a chain of detonators to a control centre—this allows the receipt of a magnetic signal, transmitted through the earth, by each detonator to be verified at the control centre. This solution, although expensive and complex, still lacks a capacity of generating real time data which is attributable to the actual blasting process.

The aforementioned process is laborious and time-consuming. An object of the invention is to address this aspect

SUMMARY OF THE INVENTION

The invention provides a blasting system which includes a blast site with a perimeter which surrounds the blast site, a plurality of spaced apart boreholes at the blast site, a plurality of detonator assemblies, each detonator assembly being positioned in a respective borehole, each detonator assembly including a respective receiver which is responsive to a magnetic signal transmitted from a control device and received by the receiver, a plurality of magnetic field strength meters (MFSMs) positioned at spaced apart locations on the perimeter, each MFSM including a respective unique identifier, each MFSM in response to a magnetic signal detected by the MFSM, producing a respective data signal which is dependent on the strength of the detected magnetic signal and which includes said unique identifier, and a communication arrangement for transmitting said data signals from said MFSMs to a data collection point.

The locations at which the MFSMs are positioned are such that upon initiation of the detonators assembles the MFSMs are not damaged.

The data collection point may be at any convenient location but preferably is at the control device.

The unique identifier associated with each MFSM may be an identity of the MFSM or of the location of the MFSM.

The communication arrangement may be configured to enable data to be transmitted from each MFSM on a continuous basis or at regular intervals. Each MFSM may be interrogated using any suitable technique and, in response to an interrogation signal sent, for example, from a transmitter at the data collection point, the MFSM may transmit said respective data signal to a receiver at the data collection point.

Prior to a blast the control device may transmit a magnetic signal and the MFSMs, which are strategically positioned at the blast site, may then be used to ensure that through-the-earth communication to the respective detonator assemblies is being effectively and successfully carried out. The data signals from the MFSMs may be transmitted to the data collection point in any suitable way which ensures that magnetic signals which could inadvertently actuate the individual detonator assemblies are absent. Thus the MFSMs may transmit the respective data signals using an appropriate wireless technique. Another possibility is to make use of a fibre optic cable arrangement to transmit the data signals from the respective MFSMs to the data collection point. Generally it would be inappropriate to link the MFSMs by means of a conductor which in use carries a current for that configuration could give rise to the generation of a magnetic field which could interfere with magnetic signals from the control device.

The fibre optic cable is positioned so that when blasting takes place the fibre optic cable is not damaged.

One or more sensors may be positioned at each selected MFSM location to monitor variable environmental parameters such as temperature, air humidity, rainfall or seismic activity. Thus each MFSM or one or more of the MFSMs selected for the purpose could be used to collect data on a range of variables and transmit that data to a data collection point located, for example, at the control device, or which is in communication with the control device.

A primary benefit of the aforegoing technique is that, by using criteria known in the art, an assessment of the data produced by the MFSMs can be made of the expected reliability of operation of the blasting system, before firing takes place.

Another advantage of the invention is that before, during, and after, a blast, the MFSMs function to monitor various events including those which occur during blasting, and after blasting as a result of the blasting. As the MFSMs and the fibre optic cable are not damaged by the blasting the MFSMs are capable of providing real time data on events which occur during blasting. This facility makes it possible for the MFSMs to be deployed to identify a misfire so that after blasting has taken place corrective action can be taken e.g to recover a misfired detonator assembly.

The invention further extends to a method of assessing reliability of operation of a blasting system which includes a blast site with a perimeter which surrounds the blast site, a plurality of spaced apart boreholes at the blast site, a plurality of detonator assemblies, each detonator assembly being positioned in a respective borehole, each detonator assembly including a respective receiver which is responsive to a magnetic signal transmitted from a control device and received by the receiver, the method comprising the steps of surrounding the blast site with a fibre optic cable which is positioned so that, upon initiation of the detonator assemblies, the fibre optic cable is not damaged, connecting a plurality of magnetic field strength meters (MFSMs) to the fibre optic cable, transmitting a magnetic signal from the control device through the earth, producing at each MFSM a data signal which is dependent on the strength of a magnetic signal detected by the MFSM, transmitting from each MFSM via the fibre optic cable to a data collection point the respective data signal, and using the data signals, received at the data collection point, to assess the reliability of through-the-earth magnetic signal transmission from the control device to the detonator assemblies.

BRIEF DESCRIPTION OF THE DRAWINGS

The invention is further described by way of example with reference to the accompanying drawings FIGS. 1, 1A and 1B which respectively schematically depict aspects of a blasting system according to the invention.

DESCRIPTION OF PREFERRED EMBODIMENT

The accompanying drawings schematically depict aspects of a blasting system 10 according to the invention.

Figure 1:
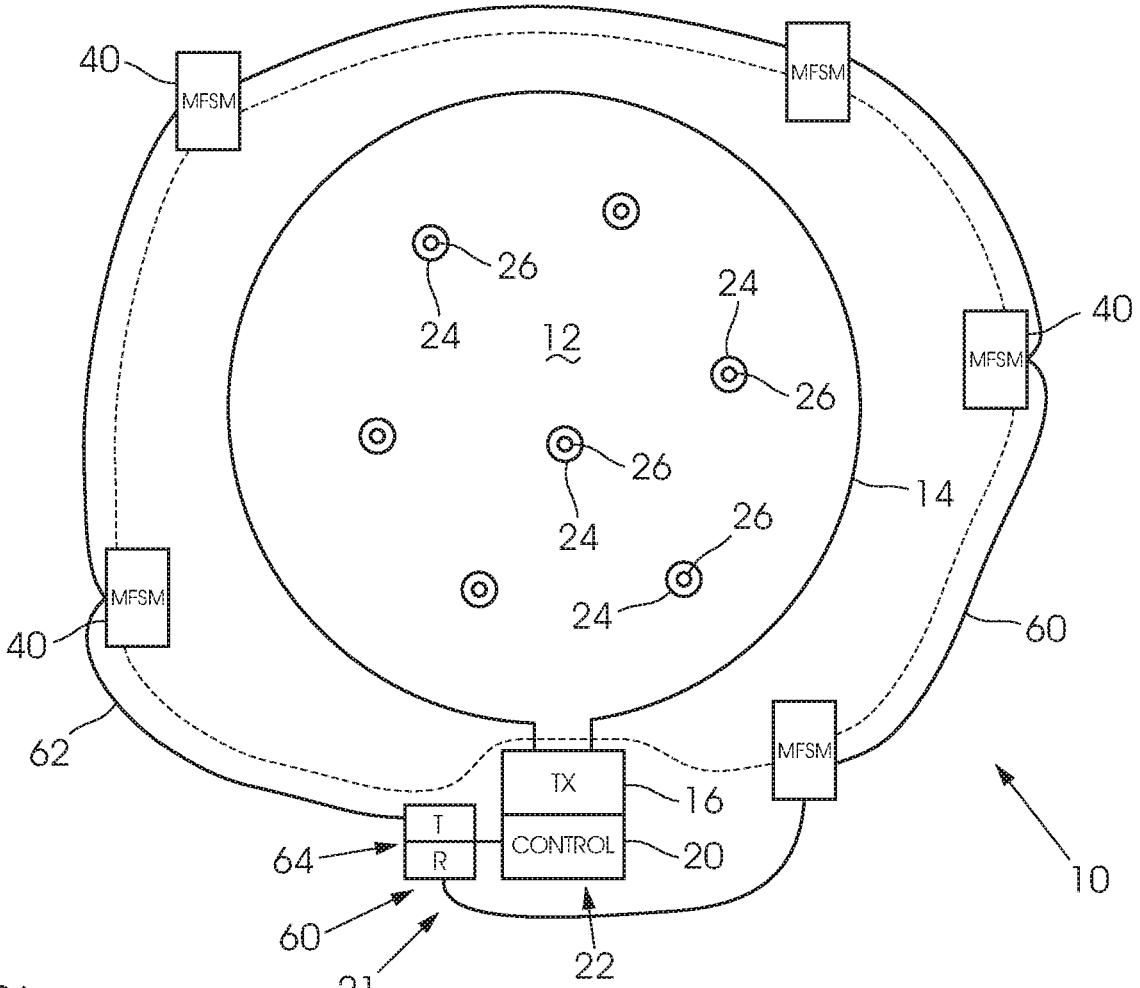
Figure 1A:
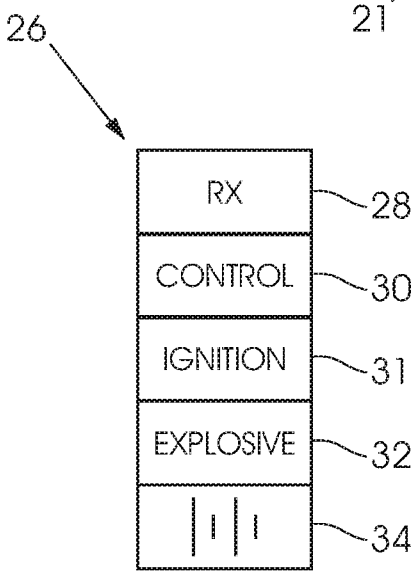

The blasting system 10 includes a blast site 12 which is surrounded by a loop antenna 14 which is connected to a transmitter 16 which is coupled to a control device 20 which comprises a data collection point 21 at a blast control centre 22. A plurality of boreholes 24 are formed at the blast site. Each borehole includes a respective detonator assembly 26 one of which is shown in more detail in FIG. 1A. Each detonator assembly includes a receiver 28, a control circuit 30 which includes an ignition element 31, an explosive 32, and a power source 34 which is used to energize the receiver 28 and the control circuit 30 and, when a fire command is received by the receiver 28 and transferred to the control circuit 30, to provide energy to fire the element 31 and thereby initiate the explosive 32.

The blast site 12 has a perimeter 36 which is indicated in dotted outline. At chosen locations on the perimeter respective magnetic field strength meters (MFSMs) 40 are positioned. Each MFSM includes a signal generator and transmitter 42 with the capability to generate a data signal 44 which is dependent on the strength of a magnetic field detected by a detector 46 in the MFSM.

Figure 1B:
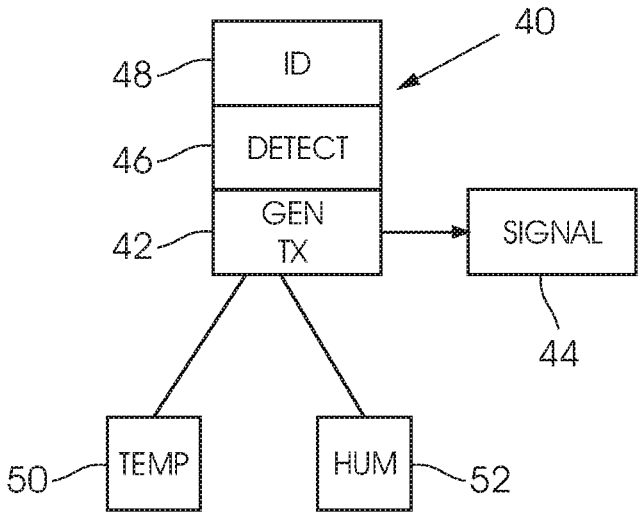

Each MFSM has a memory device in which is stored a unique identifier 48 (FIG. 1B). The identifier 48 may be linked to the MFSM 40 or it may be linked to the geographic location at which the MFSM is installed.

Respective sensors 50,52 etc may be connected, as required, to one or more selected MFSMs 40. The sensor 50 may for example be used to monitor temperature at the location of the MFSM while the sensor 52 may monitor humidity levels. Other variable environmental parameters can be monitored, as required. The invention is not limited in this respect. Data calculated by the sensors 50,52 is incorporated, as required, into the data signal 44 produced by the generator and transmitter 42.

The MFSMs 40 are linked together by means of a communication arrangement 60 which in this example comprises a fibre optic cable 62 which is coupled to a transmitter/receiver arrangement 64 at the blast control centre 22.

The transmitter 16 is designed to transmit a magnetic signal via the loop antenna 14 through the earth. That signal which is detected by the respective receiver 28 of each detonator assembly 26, is used to convey information to the individual detonator assemblies 26 for synchronising, arming and firing purposes, as is known in the art. The detonator assemblies do not have a facility to return information-carrying signals, to the blast control centre 22, for significant on-board energy would be required for this purpose at each detonator assembly. Thus the blasting system 10 is of a unidirectional nature. To ensure the reliability of operation of the blasting system it is vital to determine that magnetic signals for the controlling of the blasting process, from the control centre 22, are reliably received at the detonator assemblies 26.

The MFSMs 40 are used to address the aforementioned requirement. Each MFSM is positioned at the perimeter 36 at a chosen location which ensures that when blasting at the site 12 takes place the MFSM will not be damaged. Additionally the MFSMs are positioned so that they, collectively, can give an accurate indication of the effectiveness of magnetic signal propagation through-the-earth from the blast control centre 22. The intention in this respect is to provide a mechanism for assessing whether signals from the transmitter 16 are accurately and completely received by all the detonator assemblies 26 which are enclosed by the loop antenna 14.

Similarly the communication arrangement 60 comprising the fibre optic cable 62 which surrounds the blast site 12, linking the MFSMs together, and the transmitter/receiver arrangement 64, is positioned out of harms way to allow for continuous usage during blasting and for subsequent recovery, and reuse at a fresh blasting site.

The MFSMs at the perimeter 36 do not have to be moved prior to blasting taking place and can be used to monitor continuously the magnetic field established by the transmitter 16. Each MFSM 40 collects data at least on the magnetic field strength at its location. As indicated some or all of the MFSMs are connected to one or more sensors 50,52 to monitor various environmental or other parameters. The data relating to the strengths of magnetic signals from the transmitter 16, and the data produced by the sensors 50, 52, which is collected by each MFSM, is transmitted to the control centre 22 using the fibre optic communication mechanism 60. Data can be transmitted by each MFSM continuously or at regular intervals. Each MFSM can also be interrogated via an interrogating signal transmitted from the transmitter/receiver arrangement 64 at the blast control centre 22 on the fibre optic cable 62. Alternatively an interrogating signal could be sent from the arrangement 64 using wireless techniques. The data signals from the MFSMs are employed, using techniques known in the art, to form an assessment of the reliability of the operation of the blasting system, before firing takes place. If an MFSM indicates that, for whatever reason, the strength of a magnetic signal transmitted from the blast control centre 22 is weak or unreliable then corrective action must be taken.

The MFSMs are capable of monitoring data continuously and, in particular, data which is generated before, during, and immediately after, a blast event. This type of data can be processed to establish the effectiveness of a blast and also to identify misfires which may occur. Each MFSM detects a magnetic signal which is not necessarily produced at the control device. Consequently each MFSM produces a data signal in response to any magnetic signal which is produced by any event other than a magnetic signal transmitted from the control device. For example if the firing of a detonator, and the resulting ignition of an explosive, generate a magnetic signal then it is possible that an MFSM will detect that signal. The availability of this type of information can be used to provide an insight into the effects of blasting and possibly to identify misfires.

The blasting system 10 of the invention can be used at any appropriate location underground or on surface. In the former application, as an added safety measure, it is preferable to control the blasting process from a location on surface. Typically use is made of a central control point using an appropriate surface blast controller system which communicates using wireless techniques with the blasting system which has been described. The blasting system can be controlled from the surface blast controller for pre-blast tests and assessments and for the actual blast. Thus the magnetic signal data gathered at the blast control centre 22 by the transmitter/receiver arrangement 64 can be relayed to the surface blast controller as necessary. The process may be automated and the data which is transferred from the blast control centre 22 to the surface blast controller can be logged and displayed, as necessary, to assist in the blasting process, and is also available for post-blast assessment purposes.

This invention has been described with reference to a blasting system in which unidirectional through-the-earth magnetic signal transmission takes place. Nonetheless the techniques described herein can be used if required in a blasting system in which bi-directional magnetic signal transmission, possibly through-the-earth, occurs.

The invention claimed is:

1. A blasting system (10) comprising:

a blast site (12) with a perimeter (36) which surrounds the blast site (12), an antenna (14), a transmitter (16) at a control device (20) which, via the antenna (14), transmits a magnetic signal, a plurality of spaced apart boreholes (24) at the blast site, a plurality of detonator assemblies (26), each detonator assembly (26) being positioned in a respective borehole (24), each detonator assembly (26) including a respective receiver (28) which is responsive to the magnetic signal transmitted from the control device (20) and received by the receiver (28), a plurality of magnetic field strength meters (MFSMs) (40) respectively positioned at spaced apart locations on the perimeter (36), each MFSM (40) including a transmitter (42), a detector (46) and a respective unique identifier (48), each MFSM (40), in response to a magnetic signal detected by the respective detector (46) which was transmitted directly from the control device (20) and which is sent via the antenna (14), producing a respective data signal (44), the respective data signal (44) is dependent, at least, on the strength of the magnetic signal as determined by the detector (46), and includes said unique identifier (48), and a communication arrangement (60), for transmitting said data signals (44) from respective transmitters (42) of said MFSMs (40) to a data collection point (21) thereby to allow for assessment of the reliability of the magnetic signal transmitted from the control device (20) to the detonator assemblies (26).

2. A blasting system according to claim 1 wherein the unique identifier (48) associated with each MFSM (40) is an identity of the MFSM or of the location of the MFSM.

3. A blasting system according to claim 1 wherein the communication arrangement (60) comprises a fibre optic cable (62) which surrounds the blast site (12) and which is connected to each MFSM (40), said transmitter (42), at each MFSM (40), being configured to transmit said data signals (44), via said fibre optic cable (62), to the data collection point (21), and a receiver (64) at the data collection point (21) connected to the fibre optic cable (62) and configured to receive data signals (44) from each MFSM (40).

4. A blasting system according to claim 3 wherein the communication arrangement (60) includes a transmitter (64) for transmitting an interrogating signal to an MFSM (40) which, in response, transmits the data signal (44) from the respective transmitter (42) to said receiver (64).

5. A blasting system according to claim 1 which includes at least at one selected MFSM location, at least one sensor (50, 52) to monitor an environmental parameter, and wherein the data signal (44) produced at said MFSM (40) includes data produced by the sensor (50, 52).

6. A blasting system according to claim 1 wherein the antenna is a loop antenna (14) which surrounds the blast site (12).

7. A blasting system according to claim 1 wherein each MFSM is configured to monitor data at the respective location of the MFSM before, during and after a blast event.

8. A method of assessing reliability of operation of a blasting system (10) which includes a blast site (12) with a perimeter (36) which surrounds the blast site (12), an antenna (14), a transmitter (16) at a control device (20) which, via the antenna, transmits a magnetic signal, a plurality of spaced apart boreholes (24) at the blast site, a plurality of detonator assemblies (26), each detonator assembly (26) being positioned in a respective borehole (24), each detonator assembly (26) including a respective receiver (28) which is responsive to the magnetic signal transmitted from the control device (20) and received by the receiver (28), the method comprising:

surrounding the blast site (12) with a fibre optic cable (62), connecting at spaced apart locations a plurality of respective magnetic field strength meters (MFSMs) (40) to the fibre optic cable (62), transmitting a magnetic signal via the antenna (14) from the control device (20) through the earth directly to each MFSM (40), producing at each MFSM (40) said data signal (44) which is dependent on at least the strength of a magnetic signal detected by the MFSM, transmitting from each MFSM via the fibre optic cable (62) to a data collection point (21) the respective data signal (44), and using the data signals (44), received at the data collection point (21), to assess the reliability of through-the-earth magnetic signal transmission from the control device to the detonator assemblies (26) before blasting.

9. A method according to claim 8 wherein the data signal (44) from an MFSM (40) is transmitted in response to an interrogating signal from the control device (20).

10. A method according to claim 8 which includes the step of including in the data signal (44) from an MFSM (40), data relating to the identity of the MFSM.

11. A method according to claim 8 which includes the step of using the data signals (44) received at the data collection point (21) to monitor events which occur during blasting, and after blasting, as a result of the blasting.

12. A method according to claim 8 which includes the step, after blasting takes place at the blast site, of recovering, for reuse, the MFSMs and the fibre optic cable.

13. A method according to claim 8 which includes the step of transmitting the magnetic signal from the transmitter (16) at the control device (20) via a loop antenna (14).

14. A method according to claim 8 wherein the data signals (44) are automatically relayed to a blast controller to assist in a blasting process.

15. A method according to claim 8 wherein said data signals (44) from the MFSMs are transmitted continuously.

16. A method according to claim 10 which includes the step of including in the data signal from an MFSM (40) data relating to an environmental parameter prevailing at the location of the MFSM.

* * * * *